US005479890A

United States Patent [19]

Hu et al.

[11] Patent Number: 5,479,890

[45] Date of Patent: Jan. 2, 1996

[54] COMPRESSION RELEASE ENGINE BRAKES WITH ELECTRONICALLY CONTROLLED, MULTI-COIL HYDRAULIC VALVES

[75] Inventors: Haoran Hu, Farmington, Conn.; John A. Konopka, Feeding Hills, Mass.

[73] Assignee: Diesel Engine Retarders, Inc., Wilmington, Del.

[21] Appl. No.: 319,734

[22] Filed: Oct. 7, 1994

[51] Int. Cl.[6] ..... F01L 13/06; F02D 13/04

[52] U.S. Cl. ..... 123/322; 251/129.10

[58] Field of Search ..... 123/320, 321, 123/322; 251/129.09, 129.10; 335/219

[56] References Cited

U.S. PATENT DOCUMENTS

| | | | |
|---|---|---|---|
| Re. 33,052 | 9/1989 | Meistrick et al. | 123/321 |
| 3,220,392 | 11/1965 | Cummins | 123/321 |
| 3,743,898 | 7/1973 | Sturman | 335/254 |
| 4,572,114 | 2/1986 | Sickler | 123/21 |
| 4,664,070 | 5/1987 | Meistrick et al. | 123/321 |
| 4,936,273 | 6/1990 | Myers | 123/321 |
| 5,012,778 | 5/1991 | Pitzi | 123/321 |
| 5,146,890 | 9/1992 | Gobert et al. | 123/321 |
| 5,357,926 | 10/1994 | Hu | 123/321 |

OTHER PUBLICATIONS

Myron Brudnicki, Rotary Ball Valve, NASA Tech Briefs, Mar. 1994.

*Primary Examiner*—Willis R. Wolfe
*Attorney, Agent, or Firm*—Fish & Neave; Robert R. Jackson

[57] ABSTRACT

In a compression release engine brake for increasing the braking available from an associated internal combustion engine, an electrically controlled hydraulic valve having at least two coils and at least two positions is used to apply high pressure hydraulic fluid to a hydraulic actuator for opening an exhaust valve in the engine when a compression release event in the engine is desired. After each compression release event, the valve is switched to a condition in which it allows hydraulic fluid to drain from the hydraulic actuator, thereby allowing the associated engine exhaust valve to close.

15 Claims, 8 Drawing Sheets

COMPRESSION RELEASE ENGINE BRAKES WITH ELECTRONICALLY CONTROLLED, MULTI-COIL HYDRAULIC VALVES

BACKGROUND OF THE INVENTION

This invention relates to compression release engine brakes, and more particularly to compression release engine brakes of the general type shown in Pitzi U.S. Pat. No. 5,012,778.

As is well known from such references as Cummins U.S. Pat. No. 3,220,392, compression release engine brakes operate to temporarily convert an associated internal combustion engine from a power source to a power sinking air compressor when the fuel supply to the engine is turned off and the engine brake is turned on. The engine brake operates in this way by opening an exhaust valve (or other special valve) in at least one cylinder of the engine at times when there is compressed air in the cylinder and before the engine can recover the work of compressing that air. For example, the engine brake may open an exhaust valve near the end of each compression stroke of the engine cylinder served by that exhaust valve. This releases compressed air from the cylinder and prevents the engine from recovering the work of compressing that air during the subsequent "power" stroke of the cylinder. The engine therefore absorbs and dissipates much more energy than it otherwise would, and it becomes much more effective in slowing down the vehicle in which it is installed.

In most prior art compression release engine brakes the engine exhaust valves are opened mechanically or hydraulically. In engine brakes of the type shown in the above-mentioned Cummins patent, for example, a hydraulically operated slave piston opens each exhaust valve. A hydraulic master piston actuated by another part of the engine is hydraulically connected to each slave piston. Each forward stroke of the master piston therefore produces a forward stroke of the associated slave piston which opens the associated engine exhaust valve. The engine part which actuates the master piston is selected so that the associated exhaust valve openings will have the timing required to produce good compression release engine braking. For example, the master pistons may be operated by fuel injector mechanisms or by intake or exhaust valve opening mechanisms of the same or other engine cylinders.

Because it may be difficult or even impossible to produce optimally timed compression release events using master-slave hydraulic systems of the type described above, alternatives such as those shown in Pitzi U.S. Pat. No. 5,012,778 have been devised. (The Pitzi patent is hereby incorporated by reference herein.) In Pitzi-type systems a source of hydraulic fluid at a constant, relatively high pressure is provided. A poppet-type hydraulic valve (which is "opened" by energizing an electrical coil, and which is "closed" by a return spring when the coil is no longer energized) is also provided for selectively connecting the high pressure source to a hydraulic actuator cylinder. Each time a compression release event is desired for an engine cylinder associated with the actuator cylinder, the hydraulic valve is opened by energizing its coil. The resulting application of high pressure hydraulic fluid to the actuator cylinder causes an actuator piston in that cylinder to perform a forward stroke. This opens an exhaust valve in the associated engine cylinder. After each compression release event has occurred, the hydraulic valve is "closed" by de-energizing its coil. This disconnects the actuator cylinder from the high pressure source and instead connects the actuator cylinder to a relatively low pressure hydraulic fluid sink. The piston in the hydraulic actuator is thereby enabled to perform a return stroke, which allows the engine exhaust valve to close. Because the Pitzi patent systems are electrically controlled, the system designer has greater flexibility in selecting and implementing the timing of the compression release events.

In some applications it may be advantageous to eliminate the return spring used in the Pitzi hydraulic valve. Elimination of the return spring may help reduce the electrical current and/or voltage required to operate the hydraulic valve because, when the return spring is eliminated, the electrical coil does not have to overcome the return spring force. Elimination of the return spring may also facilitate operating the hydraulic valve more rapidly and precisely, again because the force and inertia of the return spring do not have to be overcome by the electrical coil.

In view of the foregoing, it is an object of this invention to improve compression release engine brakes of the type shown in the above-mentioned Pitzi patent.

It is a more particular object of this invention to improve the type of valves used in compression release engine brakes of the type shown in the above-mentioned Pitzi patent.

SUMMARY OF THE INVENTION

These and other objects of the invention are accomplished in accordance with the principles of the invention by replacing the single-coil hydraulic valves shown in the Pitzi patent with hydraulic valves which have at least two electrical coils, each of which coils moves a movable element in the valve to an associated position. For example, in a first position each movable valve element makes a hydraulic connection between a source of relatively high pressure hydraulic fluid and a hydraulic actuator cylinder. In a second position each movable valve element makes a hydraulic connection between the actuator cylinder and a hydraulic fluid sink which is at a relatively low pressure. Preferably the hydraulic valve does not require its electromagnet coils to overcome any spring forces in order to shift the movable valve element. This helps make it possible to keep the valve small and quick-acting with relatively little electrical power required. The movable valve element can be held in either of its two positions by applying a relatively small holding current to the appropriate coil, or residual magnetism may be sufficient to hold the movable valve element in either of its two positions with no holding current being required.

Further features of the invention, its nature and various advantages will be more apparent from the accompanying drawings and the following detailed description of the preferred embodiments.

BRIEF DESCRIPTION OF THE DRAWINGS

FIGS. 2*a* and 2*b* are plotted against the same time reference to show how they may be synchronized with one another.

FIGS. 2*c* and 2*d* are plotted against the same time reference as FIGS. 2*a* and 2*b*, again to show how all of these signals are synchronized.

DETAILED DESCRIPTION OF THE PREFERRED EMBODIMENTS

Figure 1:
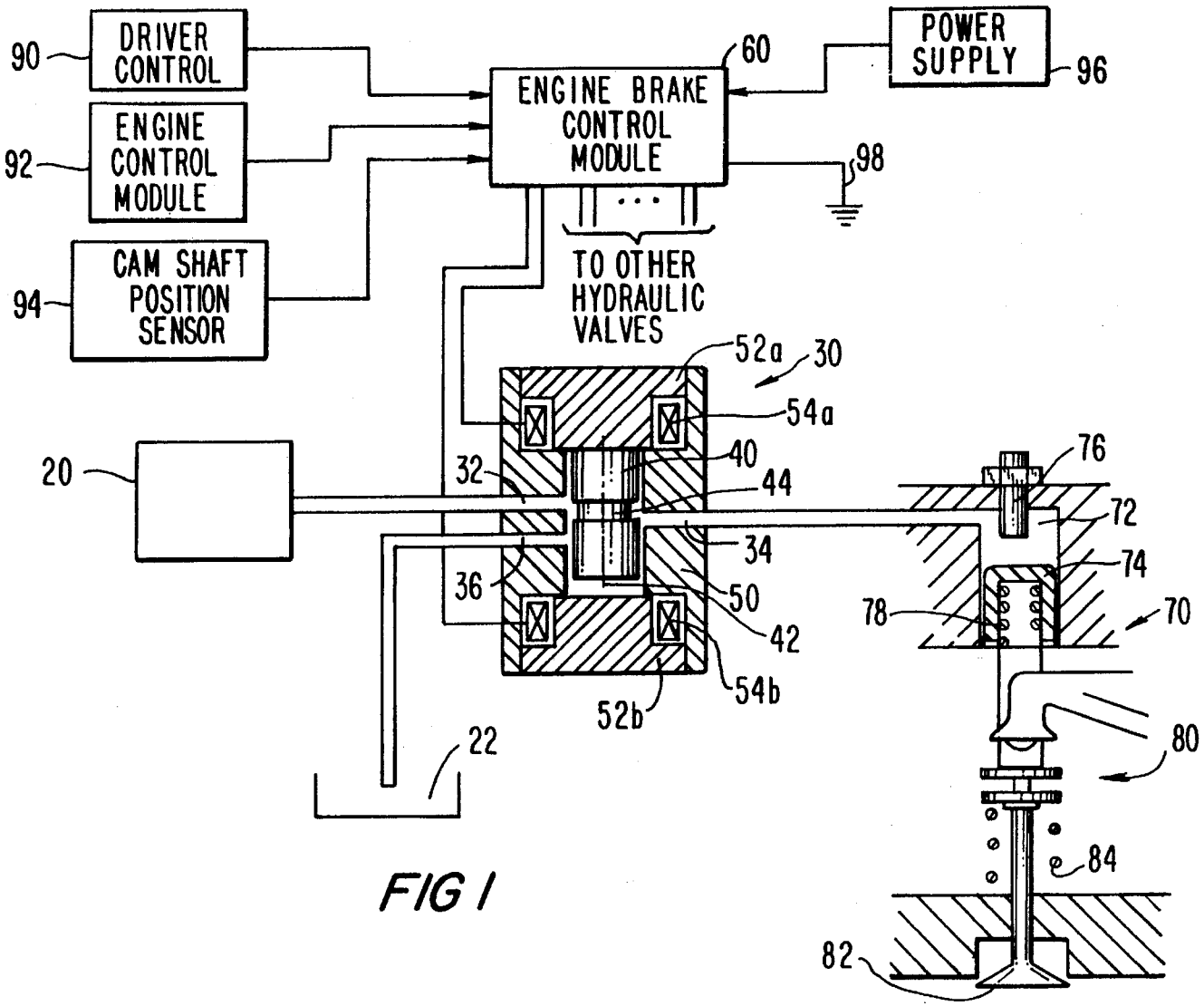
FIG. 1 is a simplified, schematic block diagram of a representative portion of an illustrative compression release engine brake constructed in accordance with the principles of this invention. Portions of an internal combustion engine associated with the engine brake are also shown in FIG. 1.

In the illustrative embodiment shown in FIG. 1 high pressure hydraulic fluid source 20 may be similar to elements 10, 14, 16, and 18 in the above-mentioned Pitzi patent. Hydraulic fluid source 20 may therefore supply hydraulic fluid at a pressure of about 3000 psi. This high pressure hydraulic fluid is supplied to the inlet port 32 of spool valve 30. As in the Pitzi patent, the hydraulic fluid may be engine lubricating oil.

Spool valve 30 has a substantially cylindrical movable valve element or spool 40 disposed in a complementary, substantially cylindrical bore in housing 50. Spool 40 is reciprocable relative to housing 50 parallel to the common central longitudinal axis 42 of the spool and bore. Except for passageway 44, the outer side surfaces of spool 40 complement the adjacent inner side surfaces of the bore in housing 50. There is a lap fit between the adjacent side surfaces of elements 40 and 50 so that spool 40 is slidable relative to housing 50 parallel to axis 42, but so that there is little or no hydraulic fluid leakage between elements 40 and 50. Spool 40 is preferably made of a ferromagnetic material or at least has ferromagnetic axial end portions.

At each end of housing 50 is a ferromagnetic pole piece 52*a*, 52*b*. A coil of wire 54*a* or 54*b* is disposed around a portion of each pole piece. When engine brake control module 60 applies an electrical current to coil 54*a*, spool 40 is electromagnetically attracted to pole piece 52*a* as shown in FIG. 1. In this position inlet port 32 is hydraulically connected to outlet port 34 via passageway 44 in spool 40. On the other hand, when engine brake control module 60 applies an electrical current to coil 54*b*, spool 40 is electromagnetically attracted to pole piece 52*b* and therefore moves down from the position shown in FIG. 1. In this position valve 30 hydraulically connects output port 34 to drain port 36 via passageway 44 in spool 40. Preferably the spacings of ports 32, 34, and 36 from one another on the inner side surfaces of housing 50 and the other relevant dimensions of valve 30 are such that valve 30 breaks the hydraulic connection between ports 32 and 34 before making the hydraulic connection between ports 34 and 36. The same is true when spool 40 moves in the opposite direction (i.e., the hydraulic connection between ports 34 and 36 is preferably broken before the hydraulic connection between ports 32 and 34 is made).

The outlet port 34 of spool valve 30 is connected to the cylinder 72 of a hydraulic actuator 70 in the engine brake. The drain port 36 of the spool valve is connected to a hydraulic fluid sink 22 having a relatively low pressure.

Hydraulic actuator cylinder 72 contains a reciprocable actuator piston 74. Piston 74 is resiliently urged upward toward return stop 76 by prestressed compression coil spring 78. However, when spool valve 30 supplies high pressure hydraulic fluid to cylinder 72, that fluid drives piston 74 down until it contacts a portion of engine exhaust valve opening mechanism 80, thereby opening exhaust valve 82 as shown in FIG. 1 and producing a compression release event in the internal combustion engine associated with the engine brake.

After each compression release event has been produced, engine brake control module 60 switches spool valve 30 to the condition in which port 34 is connected to port 36. This allows exhaust valve return spring 84 to close exhaust valve 82 and, in combination with actuator piston return spring 78, to cause actuator piston 74 to perform a return stroke. During such a return stroke, hydraulic fluid flows out of actuator cylinder 72 to sink 22 via valve 30. Although a relatively simple actuator structure 70 is shown in FIG. 1, any of the more sophisticated actuator structures shown in the Pitzi patent can be used instead if desired.

Engine brake control module 60 is preferably a conventional microprocessor and memory or a similar device. Module 60 typically receives several signals to enable it to determine when to energize each coil of valve 30. For example, these input signals to module 60 may include a driver control signal 90 (e.g., from a switch on the vehicle's dashboard) whereby the driver indicates whether or not engine braking is desired. Conventional engine control module 92 typically provides another signal or signals indicative that the engine is in a condition suitable for operation of the engine brake. For example, this signal may only be produced when the fuel supply to the engine has been cut off, when the transmission is an appropriate gear, and when the clutch is engaged. If engine brake control module 60 is programmed to automatically adjust the timing of compression release events based on such engine operating parameters as engine speed, cylinder pressure, turbocharger boost pressure, ambient air temperature, and/or ambient barometric pressure, then engine control module 92 may also provide one or more signals indicative of those engine operating parameters. Still another input to control module 60 is the output of conventional engine cam shaft position sensor 94. This signal provides the basic information required to enable module 60 to synchronize the timing of compression release events with the positions of the pistons in the engine cylinders. Module 60 also typically receives power from power supply 96 and ground potential via ground connection 98.

From the foregoing it will be apparent that the apparatus of this invention can open exhaust valve 82 to produce compression release events at any desired times. Control module 60 can be programmed to process the input parameter values it receives in accordance with a predetermined algorithm to compute the exhaust valve opening timings that are most appropriate for those input parameter values.

Alternatively, control module 60 can use its input parameter values to look up the appropriate corresponding exhaust valve opening timings in a look-up table stored in a memory of module 60. Control module 60 can thereby automatically adjust the exhaust valve opening timings to suit different engine operating conditions. For example, exhaust valve opening timings can be somewhat delayed at relatively low engine speeds to maximize the available engine braking horsepower, while at higher engine speeds the exhaust valve openings can be somewhat advanced in time to prevent excessive forces on the engine brake or the engine components acted on by the engine brake. Exhaust valve opening timings can be somewhat delayed at high ambient air temperature or at low ambient barometric pressure to compensate for the reduced mass of air typically received by the engine under those conditions. As another example analogous to so-called "cruise control" during power-mode operation of the engine, the driver of the vehicle can set a desired engine or vehicle speed during engine braking, and control module 60 can advance or retard exhaust valve openings in the manner required to maintain that engine or vehicle speed. As still another example, control module 60 can automatically adjust the amount of engine braking produced by not operating one or more of valves 30 when less engine braking is desired.

Additional information regarding illustrative electronic controls for valve 30 will be found in commonly assigned, concurrently filed application Ser. No. 08/320,049, which is hereby incorporated by reference herein. Any of the control features discussed in that application can be employed in the systems of this invention.

Figures 2A, 2B, 2C, 2D:
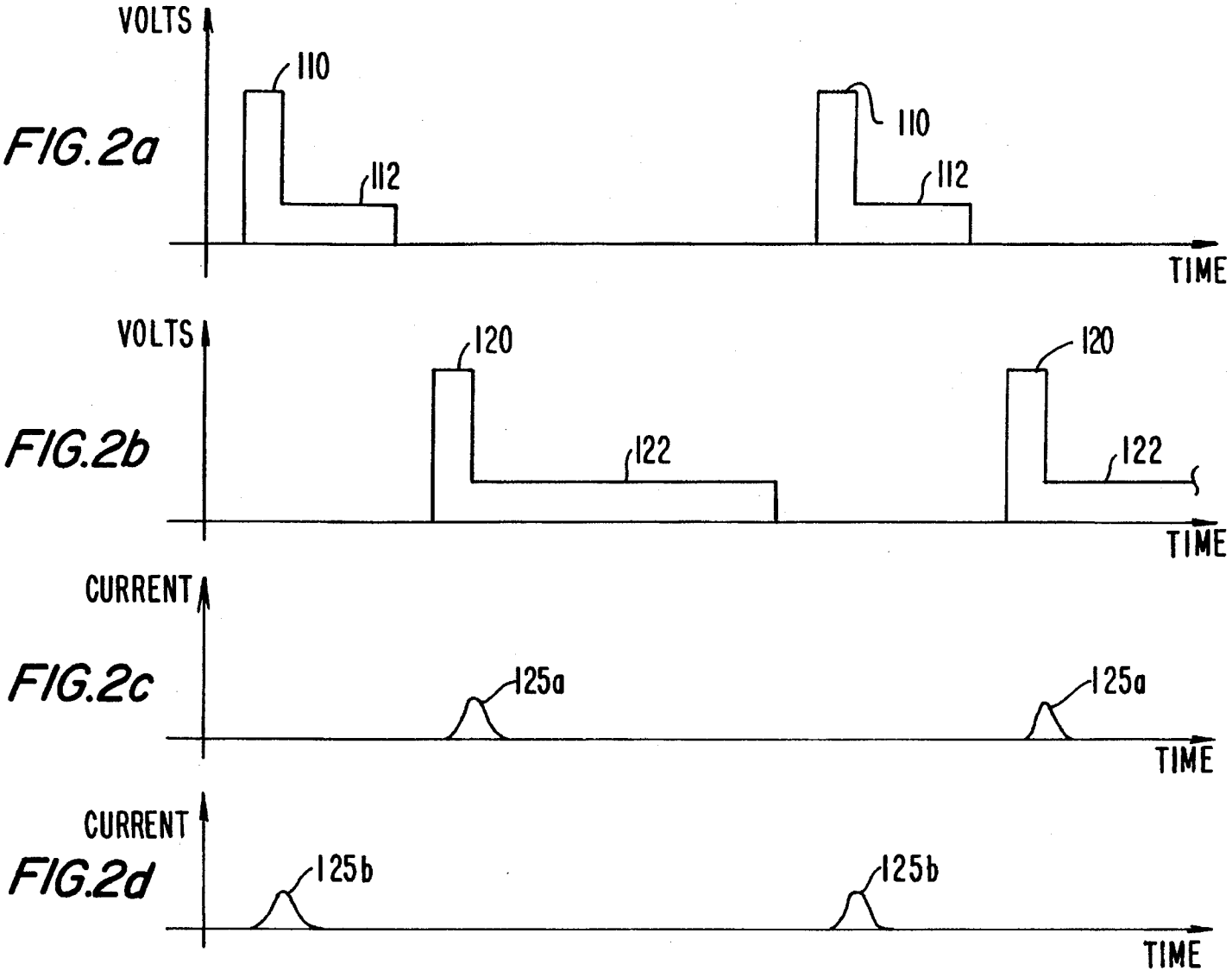
FIGS. 2*a* and 2*b* are simplified diagrams of illustrative electrical pulse trains that may be generated in a portion of the apparatus shown in FIG. 1 or other similar FIGS. or systems.
FIGS. 2*c* and 2*d* are simplified diagrams of other illustrative electrical signals that may be generated in a portion of the apparatus shown in FIG. 1 or other similar FIGS. or systems.

Spool valve 30 requires relatively little electrical power to switch it, in part because there are no return spring forces to overcome. This fact also makes it possible to hold spool 40 in either of its two positions with a relatively low holding current. For example, the signals applied to coils 54*a* and 54*b* may be as shown in FIGS. 2*a* and 2*b*, respectively. Each pulse applied to coil 54*a* includes an initial relatively high voltage portion 110 for causing spool 40 to move toward pole piece 52*a*. Thereafter a much lower voltage pulse portion 112 is applied to coil 54*a* to hold spool 40 against pole piece 52*a*. Similarly, each pulse applied to coil 54*b* includes an initial relatively high voltage portion 120 for causing spool 40 to move toward pole piece 52*b*, followed by a lower voltage holding pulse portion 122 for holding spool 40 against pole piece 52*b*. Alternatively, there may be sufficient residual magnetism after pulse portions 110 and 120 to hold spool 40 in either of its two end positions without the aid of any holding current in the coils. This would allow pulse portions 112 and 122 to be omitted.

Another refinement that is possible with valves 30 is to use each coil 54 to detect when spool 40 has shifted away from that coil. Such movement of spool 40 tends to induce a small electrical current in the adjacent coil. This is illustrated by FIGS. 2*c* and 2*d* which show electrical currents induced in coils 54*a* and 54*b*, respectively. For example, during each pulse portion 110 in FIG. 2*a*, spool 40 shifts away from coil 54*b* toward coil 54*a*. This movement of spool 40 induces a small electrical current pulse 125*b* in coil 54*b*. Control module 60 can detect each such pulse 125*b* and can use that information for such purposes as to confirm that spool 40 has shifted as intended and/or to determine when to terminate the pulse portion 110 producing that spool movement. Similarly, during each pulse portion 120 in FIG. 2*b*, spool 40 shifts away from coil 54*a* toward coil 54*b*. Control module 60 can detect the resulting electrical current pulse 125*a* induced in coil 54*a* in order to confirm the intended movement of spool 40 and/or to determine when to terminate the pulse portion 120 causing that spool movement.

Figure 2E:
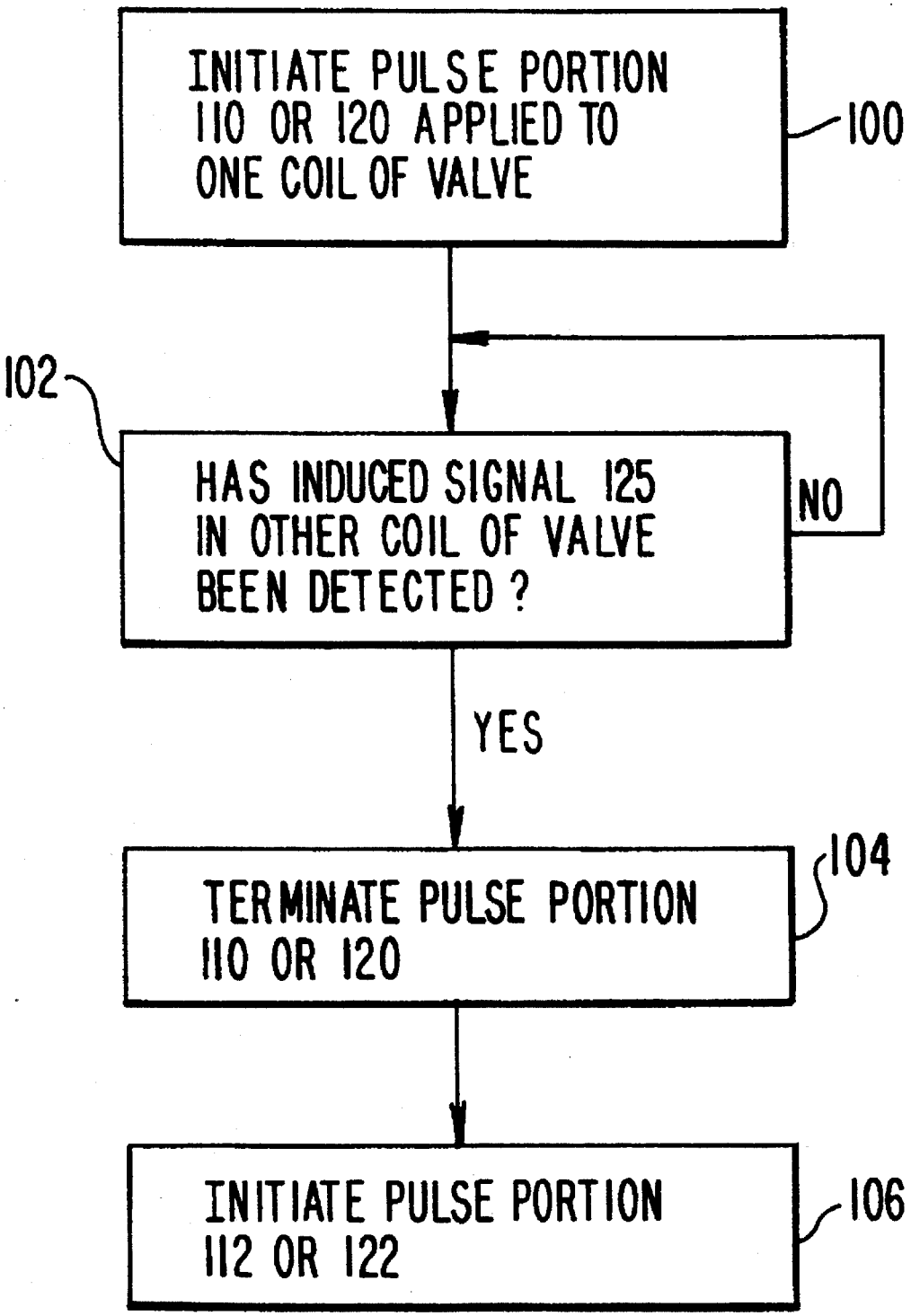
FIG. 2*e* is a flow chart of illustrative operating sequence steps that can be performed in accordance with this invention as part of the operation of one of the components shown in FIG. 1 or other similar FIGS. or systems.

FIG. 2*e* shows an illustrative operating sequence for control module 60 to make use of signals of the type shown in FIGS. 2*c* and 2*d* to determine when control module 60 should terminate the portion 110 or 120 of each pulse shown in FIGS. 2*a* and 2*b*. In step 100 processor 60 begins to apply the portion 110 or 120 of a pulse to the associated coil in valve 30. In step 102 processor 60 monitors the other coil of valve 30 until an induced current pulse 125 is detected in that other coil, thereby indicating that spool 40 has shifted. Control then passes from step 102 to step 104. In step 104 processor 60 terminates the pulse portion 110 or 120 initiated in step 100. In step 106 processor initiates the portion 112 or 122 of the pulse referred to in steps 100 and 104. This pulse portion 112 or 122 continues until shortly before processor 60 is read to initiate the portion 110 or 120 of the next pulse (to be applied to the other coil of valve 30). As an alternative, step 106 can be omitted if residual magnetism is sufficient to hold spool 40 in place after it has been shifted by pulse portions 110 or 120.

Figure 3:
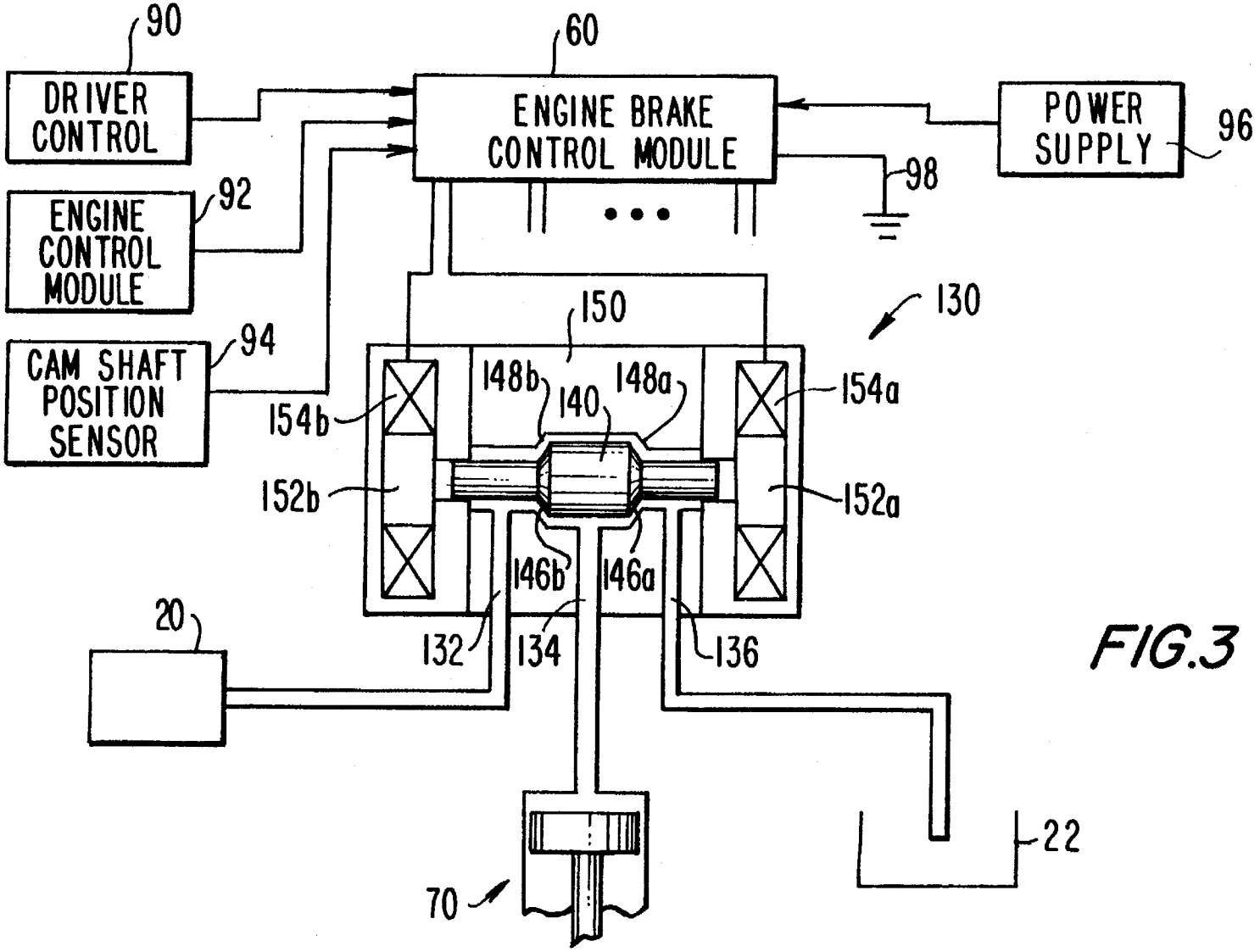
FIG. 3 is a view similar to FIG. 1 showing an alternative type of hydraulic valve which can be used in accordance with the invention.

FIG. 3 shows an alternative embodiment in which a two-coil poppet-type valve 130 is used in place of each spool-type valve 30 in the embodiment shown in FIG. 1. Except for the use of a different type of hydraulic valve, the apparatus of FIG. 3 may be constructed and may operate similarly to the apparatus of FIG. 1. Parts in FIG. 3 that are substantially the same as parts in FIG. I have the same reference numbers in both FIGS. and will not be described again in connection with FIG. 3. Parts in FIG. 3 that are generally similar to parts in FIG. 1 have reference numbers that are increased by 100 as compared to FIG. 1.

With more specific reference to FIG. 3, movable valve element or plunger 140 is disposed in housing 150 for movement left or right relative to the housing. Plunger 140 is electromagnetically attracted to the right when engine brake control module 60 energizes coil 154*a* and thereby magnetizes pole piece 152*a*. Plunger 140 shifts to the left when control module 60 energizes coil 154*b* and thereby magnetizes pole piece 152*b*. When plunger 140 is attracted to the right, the shoulder 146*a* on the enlarged portion of the plunger seats against the shoulder 148*a* on the inside of housing 150. This prevents hydraulic fluid from flowing from either high pressure hydraulic fluid source 20 or from actuator 70 to low pressure hydraulic fluid sump 22. However, with plunger 140 in this position, high pressure hydraulic fluid can flow from source 20, through valve inlet port 132 and valve port 134 to actuator 70 to drive the piston in the actuator down and thereby produce a compression release event in the associated engine.

When a compression release event has been produced and it is desired to allow actuator 70 to perform a return stroke, engine brake control module 60 energizes coil 154*b* instead of coil 154*a*. This shift plunger 140 to the left, thereby causing plunger shoulder 146*b* to seat against housing seat 148*b*. With plunger 140 in this position high pressure hydraulic fluid supply 20 is cut off from actuator 70. Instead, hydraulic fluid can flow from actuator 70 through valve ports 134 and 136 to sump 22, thereby allowing actuator 70 to perform a return stroke.

Although valve 130 is constructed somewhat differently than valve 30, many of the operating principles discussed above in connection with valve 30 are equally applicable to valve 130. For example, the types of coil-energizing signals shown in FIGS. 2*a* and 2*b* can be used to operate valve 130, and the valve-monitoring signals shown in FIGS. 2*c* and 2*d* can also be detected in valve 130.

Figure 4:
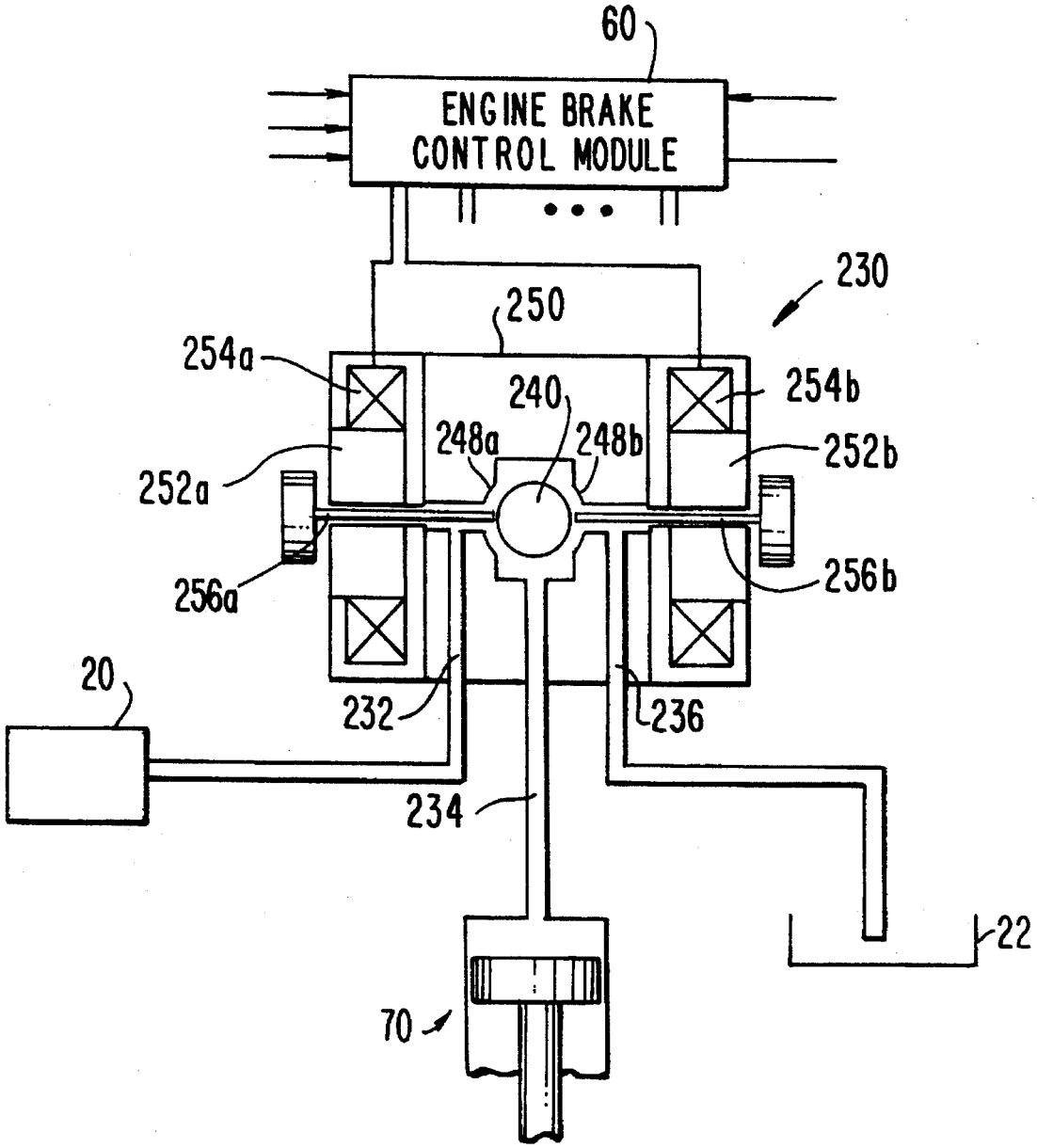
FIG. 4 is another view similar to a portion of FIG. 1 or FIG, 3 showing another alternative type of hydraulic valve which can be used in accordance with the invention.

Another alternative embodiment is shown in FIG. 4. In this alternative the moving element in hydraulic valve 230 is ball 240. Ball 240 can be pushed to the right in housing 250 by electrically energizing coil 254*a* in the valve. This magnetizes pole piece 252*a* which attracts the head of pin 256*a* to that armature. The end of pin 256a remote from pole piece 252*a* then pushes ball 240 against seat 248*b* in housing 250. This prevents hydraulic fluid from flowing from valve 230 to sump 22, but allows high pressure hydraulic fluid to flow from source 20 through valve 230 to actuator 70, thereby causing a forward stroke of the actuator and producing a compression release event in the associated engine. After the compression release event has been produced, engine brake control module 60 energizes coil 254*b* rather than coil 254*a*. This attracts the head of pin 256*b* to pole piece 252*b*, thereby pushing ball 240 to the left against seat 248*a* in housing 250. With ball 240 against seat 248*a* the supply of high pressure hydraulic fluid from source 20 is cut off and actuator 70 can instead drain to sump 22 via valve 230.

Although valve 230 is constructed somewhat differently than valve 130, all of the operating principles discussed above in connection with valve 130 are equally applicable to systems employing valves like valve 230. Also, although described above as a ball, those skilled in the art will appreciate that element 240 can have other shapes. For example, element 240 can be a cylinder whose longitudinal axis is perpendicular to the plane of the paper on which FIG. 4 is drawn.

Figure 5:
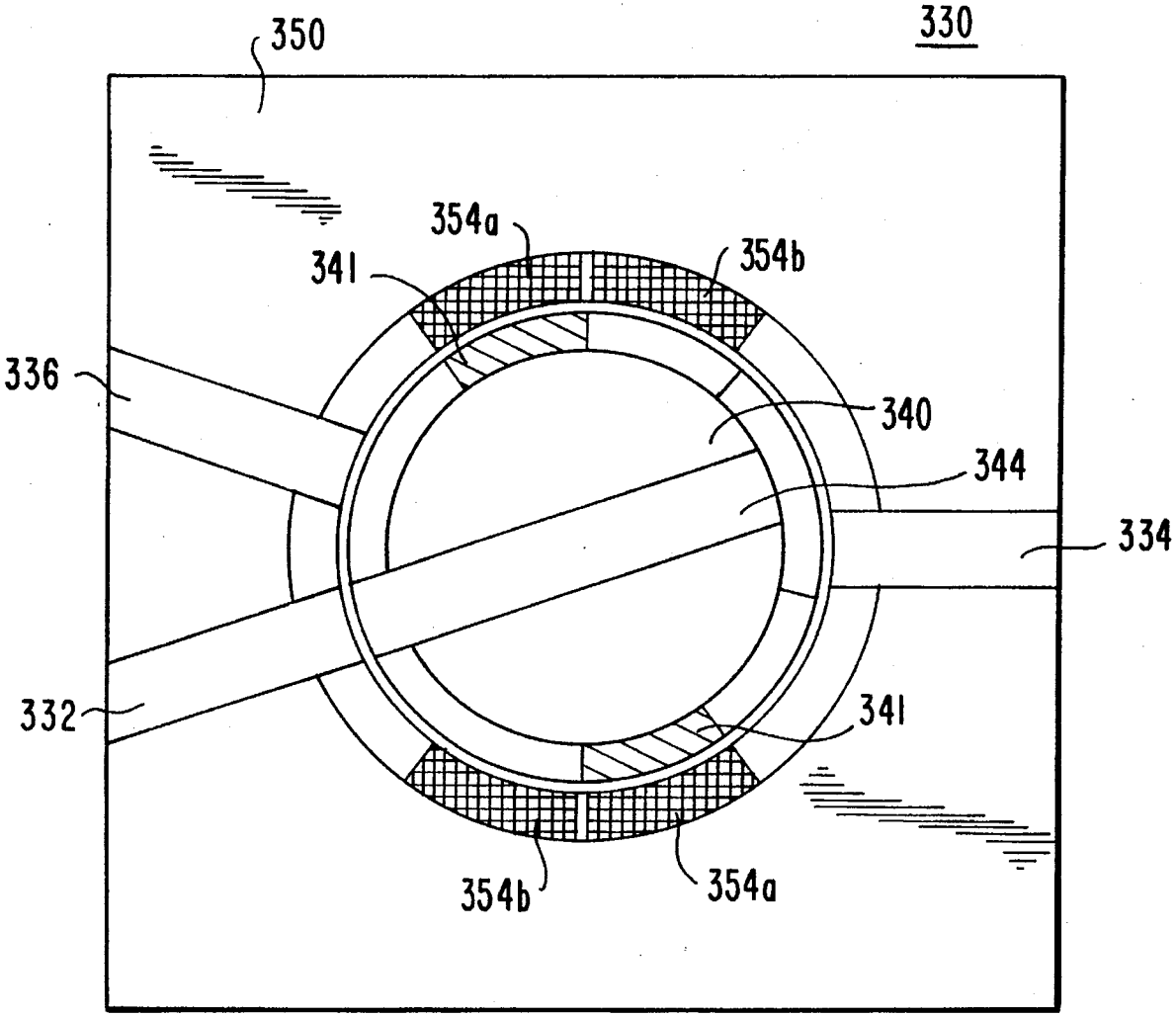
FIG. 5 is a simplified, sectional view of still another type of hydraulic valve which can be used in accordance with the invention.

FIG. 5 shows still another type of multiple-coil hydraulic valve 330 that can be used in the systems of this invention. In valve 330 ball or cylinder 340 is rotatable relative to housing 350 about a central axis which is perpendicular to the plane of the sheet on which FIG. 5 is drawn. Permanent magnets 341 are carried by ball or cylinder 340. When coils 54*a* are energized, ball 340 rotates counter-clockwise to the position shown in FIG. 5, thereby connecting high pressure hydraulic fluid inlet 332 to hydraulic actuator connection 334 via the passageway 344 through ball or cylinder 340. On the other hand, when coils 54*b* rather than coils 354*a* are energized, ball or cylinder 340 rotates clockwise approximately 36° from the position shown in FIG. 5. This disconnects conduit 332 from conduit 334, and instead connects conduit 334 to low pressure hydraulic fluid sump connection 336.

Once again, the operating principles discussed above in connection with the other hydraulic valve types are applicable to systems employing valves of the type shown in FIG. 5.

Figure 6:
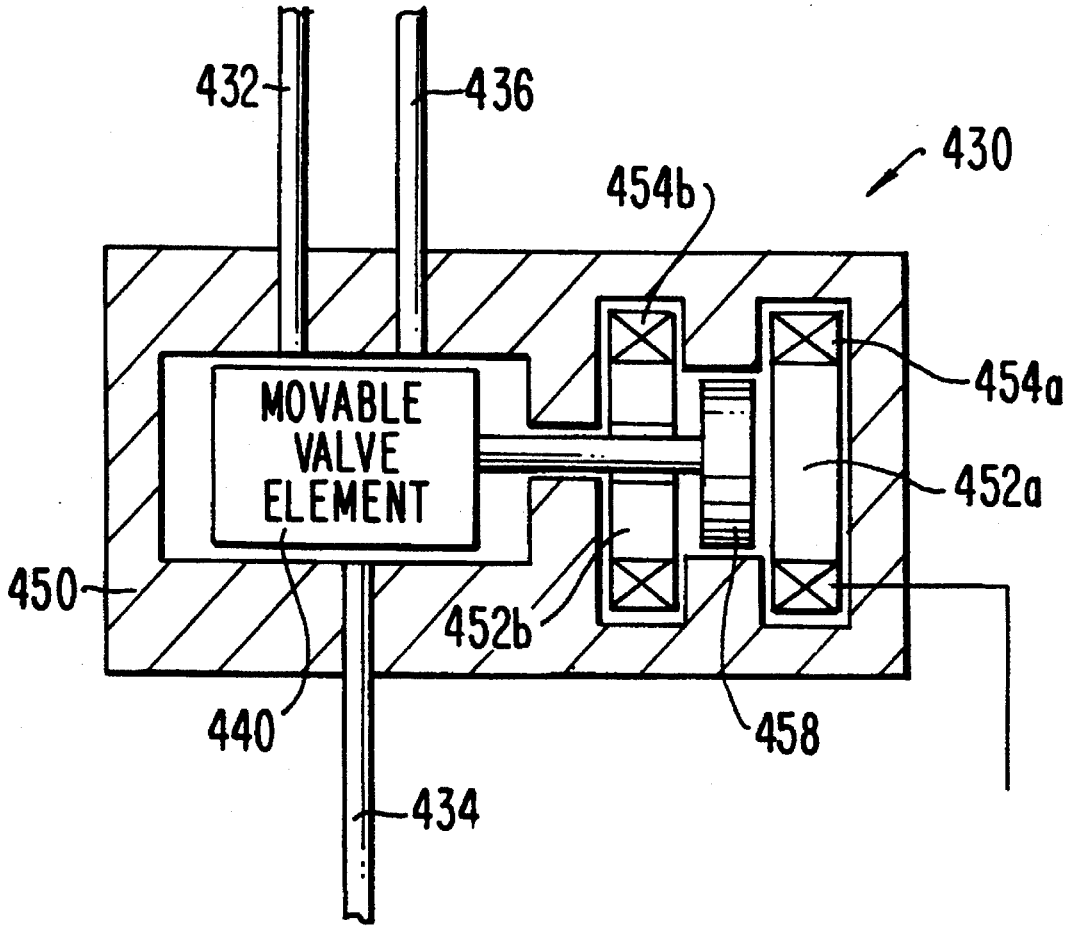
FIG. 6 is a simplified, sectional view of yet another type of hydraulic valve which can be used in accordance with the invention.

FIG. 6 shows yet another type of multiple-coil hydraulic valve 430 that can be used in the systems of this invention. This valve may be similar to previously described valves such as valve 30 in FIG. 1 or valve 130 in FIG. 3, except that in valve 430 both of electromagnetic coils 454*a* and 454*b* are on the same side or end of movable valve element 440. When coil 454*a* is energized, movable armature member 458 is electromagnetically attracted to and shifts toward fixed pole piece 452*a*. This shifts movable valve element 440 so that it closes off conduit 436 but makes a hydraulic connection between conduits 432 and 434. On the other hand, when coil 454*b* is energized, movable armature 458 is attracted to and shifts toward fixed pole piece 452*b*. This shifts movable valve element 440 so that it closes off conduit 432 but makes a hydraulic connection between conduits 434 and 436.

Figure 7:
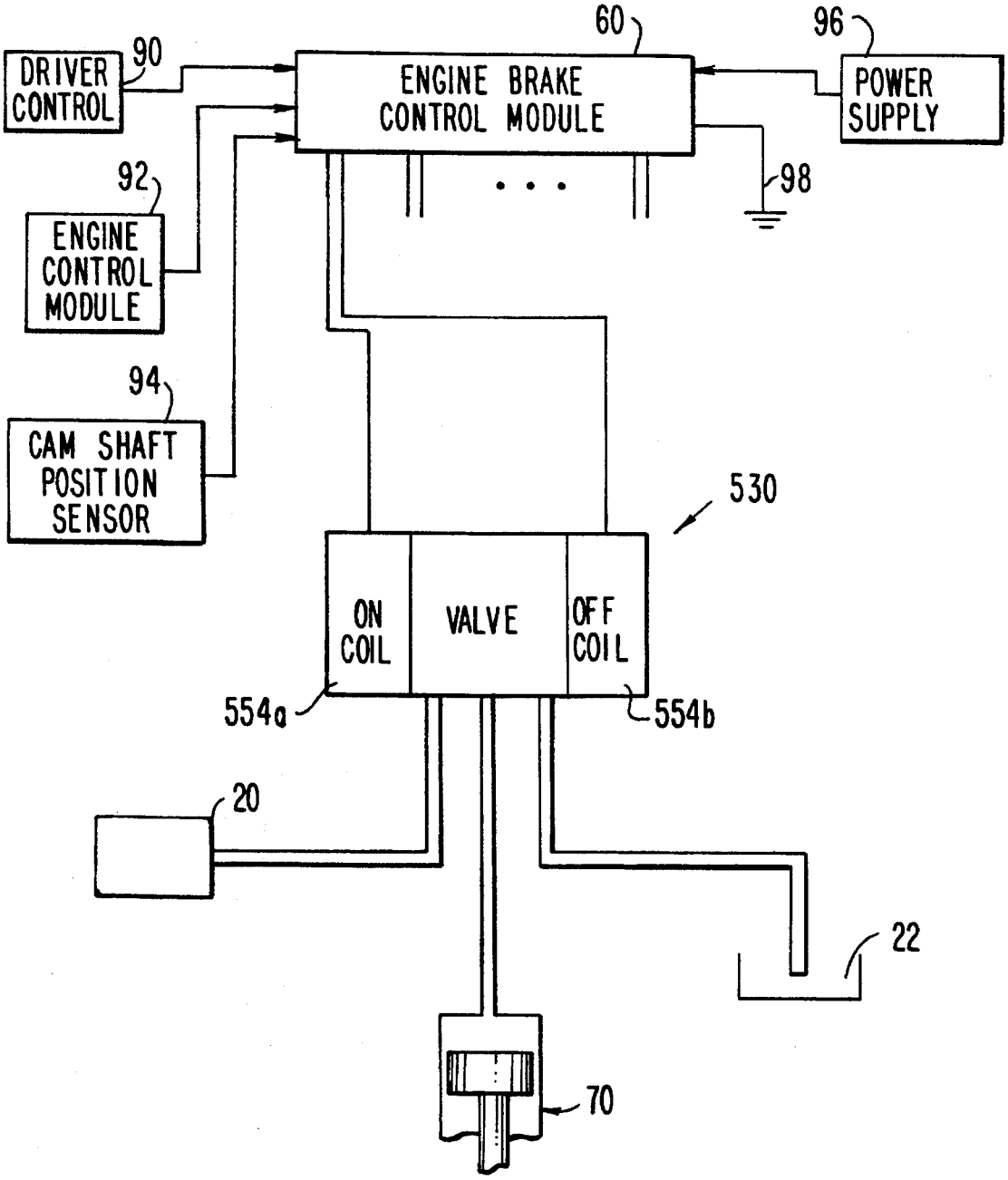
FIG. 7 is another view similar to FIG. 1 showing a more generic embodiment of the invention.

Although several illustrative hydraulic valves have been shown and described, those skilled in the art will appreciate that other types of multi-coil hydraulic valves can be used if desired. Thus FIG. 7 shows a generic type of valve 530 in accordance with this invention. Once again, elements shown in FIG. 7 that have been previously described have the same reference numbers used in other FIGS. and will not be described again. Valve 530 has an "on" coil 554*a* and an "off" coil 554*b*. When "on" coil 554*a* is energized by engine brake control module 60, valve 530 connects high pressure hydraulic fluid source 20 to actuator 70. This causes actuator 70 to perform a forward stroke, thereby producing a compression release event in the associated engine. After the compression release event has been produced, control module 60 energizes "off" coil 554*b*. This disconnects actuator 70 from hydraulic fluid source 20 and connects the actuator instead to hydraulic fluid sump 22. Actuator 70 is then able to perform a return stroke.

It will be understood that the foregoing is only illustrative of the principles of the invention and that various modifications can be made by those skilled in the art without departing from the scope and spirit of the invention. For example, to some extent the various FIGS. show only the elements required to produce compression release events in one engine cylinder. It will be appreciated, however, that those elements can be duplicated to produce compression release events in as many engine cylinders as are desired. Although in the foregoing discussion it is assumed that valve 82 is a conventional exhaust valve, those skilled in the art will appreciate that it can alternatively be a special-purpose valve added just for use during engine braking as shown, for example, in Gobert et al. U.S. Pat. No. 5,146,890. Such additional valves are very much like conventional exhaust valves, and so it will be understood that terms like "exhaust valve" used herein and in the appended claims include both conventional exhaust valves and special-purpose valves added for use to produce compression release events. If desired, the apparatus of this invention can be used not only to produce compression release events near the end of the compression strokes of the engine cylinders, but alternatively or in addition to produce compression release events near the end of the exhaust strokes of the engine cylinders if the engine is capable of suppressing its normal exhaust-stroke exhaust valve openings during operation of the engine brake. See, for example, Sickler U.S. Pat. No. 4,572,114 which shows conversion of a four-cycle engine to a two-cycle air compressor during engine braking.

The invention claimed is:

1. A compression release engine brake for opening an exhaust valve in a cylinder of an internal combustion engine associated with the engine brake to release air compressed in that cylinder comprising:

a source of hydraulic fluid at a relatively high pressure;

a sink of hydraulic fluid at a relatively low pressure;

an actuator piston reciprocable in an actuator piston cylinder, said exhaust valve being opened by a forward stroke of said actuator piston in response to said relatively high pressure hydraulic fluid being introduced into said actuator piston cylinder, and said actuator piston performing a return stroke which allows said exhaust valve to close when said actuator piston cylinder is hydraulically connected to said sink of hydraulic fluid;

a valve having a movable structure movable between first and second positions relative to a housing, said movable structure opening a hydraulic connection between said source of hydraulic fluid and said actuator piston cylinder when said movable structure is in said first position, and said movable structure opening a hydraulic connection between said actuator piston cylinder and said sink of hydraulic fluid when said movable structure is in said second position, said valve including first and second electromagnets for respectively causing said movable structure to move to said first and second positions; and an electrical control for selectively energizing said first and second electromagnets.

2. The apparatus defined in claim 1 wherein said movable structure includes an electromagnetically rotatable member.

3. The apparatus defined in claim 1 wherein said movable structure includes a poppet member movable between first and second valve seats, said poppet member closing a passageway through said first valve seat when said movable structure is in said first position and said poppet member is accordingly against said first valve seat, and said poppet member closing a passageway through said second valve seat when said movable structure is in said second position and said poppet member is accordingly against said second valve seat.

4. The apparatus defined in claim 3 wherein said poppet member is a ball.

5. The apparatus defined in claim 3 wherein said poppet member is a cylinder.

6. The apparatus defined in claim 1 wherein said movable structure includes a spool having a longitudinal axis, and wherein said spool reciprocates between said first and second positions parallel to said axis.

7. The apparatus defined in claim 6 wherein said spool has outer side surfaces that are substantially parallel to said axis, and wherein said housing has inner side surfaces that are substantially parallel to said axis, complementary to said outer side surfaces, and in sliding contact with said outer side surfaces substantially parallel to said axis.

8. The apparatus defined in claim 7 wherein said housing member has first, second, and third ports through said inner side surfaces, said first port being hydraulically connected to said source of hydraulic fluid, said second port being hydraulically connected to said sink of hydraulic fluid, and said third port being hydraulically connected to said actuator cylinder, and wherein said spool has a passageway for hydraulically connecting said first and third ports when said spool is in said first position and for hydraulically connecting said second and third ports when said spool is in said second position.

9. The apparatus defined in claim 1 wherein each of said first and second electromagnets comprises:

a respective one of first and second electrical coils for respectively moving said movable structure to said first or second position when electrical current is passed through said first or second electrical coil.

10. The apparatus defined in claim 9 wherein said electrical control further comprises:

a controller for applying an electrical pulse to at least one of said coils, said pulse including a first electrically strong portion for causing said movable structure to move to an associated position, and a second electrically weak portion for holding said movable structure in said associated position.

11. The apparatus defined in claim 9 wherein each of said first and second electromagnets further comprises:

a respective one of first and second pole pieces.

12. The apparatus defined in claim 11 wherein said movable structure is held in at least one of said first and second positions by residual magnetic attraction between said movable structure and the pole piece of the one of said first and second electromagnets which is adjacent to said movable structure in said at least one of said first and second positions.

13. The apparatus defined in claim 9 wherein said electrical control applies an electrical pulse to at least one of said coils while monitoring the other of said coils for an electrical signal induced in said other of said coils due to movement of said movable structure relative to said coils.

14. The apparatus defined in claim 13 wherein said electrical control responds to detection of said induced electrical signal by at least substantially reducing the strength of the electrical pulse applied to said at least one of said coils.

15. The apparatus defined in claim 14 wherein said electrical control responds to detection of said induced electrical signal by terminating the electrical pulse applied to said at least one of said coils.

* * * * *